US008469745B2

(12) United States Patent
Davis et al.

(10) Patent No.: US 8,469,745 B2
(45) Date of Patent: Jun. 25, 2013

(54) ELECTRICAL CONNECTOR SYSTEM

(75) Inventors: Wayne Samuel Davis, Harrisburg, PA (US); Robert Neil Whiteman, Jr., Middletown, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 291 days.

(21) Appl. No.: 12/950,232

(22) Filed: Nov. 19, 2010

(65) Prior Publication Data

US 2012/0129395 A1 May 24, 2012

(51) Int. Cl.
*H01R 13/648* (2006.01)

(52) U.S. Cl.
USPC ..... 439/607.07

(58) Field of Classification Search
USPC ..... 439/607.07, 607.05, 607.06
See application file for complete search history.

(56) References Cited

U.S. PATENT DOCUMENTS 4,705,332 A * 11/1987 Sadigh-Behzadi ..... 439/69
4,846,727 A * 7/1989 Glover et al. ..... 439/607.07
5,702,258 A * 12/1997 Provencher et al. ..... 439/79
5,795,191 A * 8/1998 Preputnick et al. ..... 439/607.11
5,993,259 A * 11/1999 Stokoe et al. ..... 439/607.09
6,293,827 B1 * 9/2001 Stokoe ..... 439/607.07
6,299,484 B2 * 10/2001 Van Woensel ..... 439/607.07
6,364,710 B1 * 4/2002 Billman et al. ..... 439/607.11
6,371,813 B2 * 4/2002 Ramey et al. ..... 439/607.05
6,431,914 B1 * 8/2002 Billman ..... 439/607.07
6,435,914 B1 * 8/2002 Billman ..... 439/607.07
6,506,076 B2 * 1/2003 Cohen et al. ..... 439/607.09
6,551,140 B2 * 4/2003 Billman et al. ..... 439/607.07
6,607,402 B2 * 8/2003 Cohen et al. ..... 439/607.11
6,645,009 B1 * 11/2003 Billman et al. ..... 439/607.07
6,709,294 B1 * 3/2004 Cohen et al. ..... 439/607.07
6,743,057 B2 * 6/2004 Davis et al. ..... 439/701
6,808,420 B2 * 10/2004 Whiteman et al. ..... 439/607.08
6,824,391 B2 * 11/2004 Mickievicz et al. ..... 439/61
6,899,566 B2 * 5/2005 Kline et al. ..... 439/607.56
6,979,215 B2 * 12/2005 Avery et al. ..... 439/248
6,979,226 B2 * 12/2005 Otsu et al. ..... 439/607.07
7,267,515 B2 * 9/2007 Lappohn ..... 439/607.07
7,371,117 B2 * 5/2008 Gailus ..... 439/607.08
7,381,092 B2 * 6/2008 Nakada ..... 439/607.1
7,384,311 B2 * 6/2008 Sharf et al. ..... 439/607.05
7,534,142 B2 * 5/2009 Avery et al. ..... 439/607.05
7,649,146 B2 * 1/2010 Avery et al. ..... 174/262
7,722,401 B2 * 5/2010 Kirk et al. ..... 439/607.07
7,753,731 B2 * 7/2010 Cohen et al. ..... 439/607.09
7,878,853 B2 * 2/2011 Amleshi et al. ..... 439/607.08
7,931,500 B2 * 4/2011 Knaub et al. ..... 439/607.07
7,985,097 B2 * 7/2011 Gulla ..... 439/607.39
7,988,491 B2 * 8/2011 Davis et al. ..... 439/607.27

(Continued)

*Primary Examiner* — Neil Abrams

(57) ABSTRACT

An electrical connector system may include a plurality of wafer assemblies. Each wafer assembly may include a first overmolded array of electrical contacts defining a plurality of apertures; a second overmolded array of electrical contacts configured to be assembled with the first overmolded array of electrical contacts, the second overmolded array of electrical contacts defining a plurality of apertures; and a conductive ground bracket positioned in the wafer assembly between the first overmolded array of electrical contacts and the second array of electrical contacts. The conductive ground bracket defines a first array of ridges, each ridge of the first array of ridges positioned in an aperture of the first overmolded array of electrical contacts. The conductive ground bracket defines a second array of ridges, each ridge of the second array of ridges positioned in an aperture of the second overmolded array of electrical contacts.

19 Claims, 14 Drawing Sheets

U.S. PATENT DOCUMENTS 8,002,581 B1 * 8/2011 Whiteman et al. ..... 439/607.18
8,167,651 B2 * 5/2012 Glover et al. ..... 439/607.08
8,187,034 B2 * 5/2012 Fedder et al. ..... 439/607.01
8,262,412 B1 * 9/2012 Minnick et al. ..... 439/607.01
2009/0239395 A1 * 9/2009 Cohen et al. ..... 439/65
2012/0129394 A1 * 5/2012 Davis et al. ..... 439/607.01
2012/0184138 A1 * 7/2012 Davis et al. ..... 439/607.3

* cited by examiner

ELECTRICAL CONNECTOR SYSTEM

RELATED APPLICATIONS

The present application is related to U.S. patent application Ser. No. 12/950,210, titled "Electrical Connector System," filed Nov. 19, 2010, the entirety of which is hereby incorporated by reference.

BACKGROUND

As shown in FIG. 1, backplane connector systems 1 are typically used to connect a first substrate 2, such as a printed circuit board, in parallel or in a perpendicular relationship with a second substrate 3, such as another printed circuit board. As the size of electronic components is reduced and electronic components generally become more complex, it is often desirable to fit more components in less space on a circuit board or other substrate. Consequently, it has become desirable to reduce the spacing between electrical terminals within backplane connector systems and to increase the number of electrical terminals housed within backplane connector systems. Accordingly, it is desirable to develop backplane connector systems capable of operating at increased speeds, while also increasing the number of electrical terminals housed within the backplane connector system.

SUMMARY OF THE INVENTION

The high-speed backplane connector systems described below address these desires by providing electrical connector systems that are capable of operating at speeds of up to at least 20 Gbps.

In one aspect, an electrical connector system is disclosed. The system may include a plurality of wafer assemblies defining a mating end and a mounting end. Each of the wafer assemblies may include a first overmolded array of electrical contacts, a second overmolded array of electrical contacts configured to be assembled with the first overmolded array of electrical contacts, and a conductive ground bracket positioned in the wafer assembly between a portion of the first overmolded array of electrical contacts and a portion of the second array of electrical contacts.

The first overmolded array of electrical contacts define a plurality of apertures and each electrical contact of the first overmolded array of electrical contacts may define an electrical mating connector extending past an edge of an overmold of the first overmolded array of electrical contacts at the mating end of the wafer assembly. Similarly, the second overmolded array of electrical contacts define a plurality of apertures and each electrical contact of the second overmolded array of electrical contacts may define an electrical mating connector extending past an edge of an overmold of the second overmolded array of electrical contacts at the mating end of the wafer assembly.

The conductive ground bracket may define a first array of ridges on a first side of the conductive ground bracket, where each ridge of the first array of ridges is positioned in an aperture of the plurality of apertures defined by the first overmolded array of electrical contacts. The conductive ground bracket may define a second array of ridges on a second side of the conductive ground bracket that is opposite to the first side of the conductive ground bracket, where each ridge of the second array of ridges is positioned in an aperture of the plurality of apertures defined by the second overmolded array of electrical contacts.

In another aspect, a wafer assembly is disclosed. The wafer assembly may include a first overmolded array of electrical contacts, a second overmolded array of electrical contacts configured to be assembled with the first overmolded array of electrical contacts, and a conductive ground bracket positioned in the wafer assembly between a portion of the first overmolded array of electrical contacts and a portion of the second array of electrical contacts.

The first overmolded array of electrical contacts define a plurality of apertures and each electrical contact of the first overmolded array of electrical contacts may define an electrical mating connector extending past an edge of an overmold of the first overmolded array of electrical contacts at a mating end of the wafer assembly. Similarly, the second overmolded array of electrical contacts define a plurality of apertures and each electrical contact of the second overmolded array of electrical contacts may define an electrical mating connector extending past an edge of an overmold of the second overmolded array of electrical contacts at the mating end of the wafer assembly.

The conductive ground bracket may define a first array of ridges on a first side of the conductive ground bracket, where each ridge of the first array of ridges is positioned in an aperture of the plurality of apertures defined by the first overmolded array of electrical contacts. The conductive ground bracket may define a second array of ridges on a second side of the conductive ground bracket that is opposite to the first side of the conductive ground bracket, where each ridge of the second array of ridges is positioned in an aperture of the plurality of apertures defined by the second overmolded array of electrical contacts.

In yet another aspect, another wafer assembly is disclosed. The wafer assembly may include a first overmolded array of electrical contacts, a first ground shield, a second overmolded array of electrical contacts configured to be assembled with the first overmolded array of electrical contacts, a second ground shield, and a conductive ground bracket positioned in the wafer assembly between a portion of the first overmolded array of electrical contacts and a portion of the second array of electrical contacts.

The first overmolded array of electrical contacts may define a plurality of apertures and each electrical contact of the first overmolded array of electrical contacts may define an electrical mating connector extending past an edge of an overmold of the first overmolded array of electrical contacts at a mating end of the wafer assembly. The first ground shield is configured to be assembled with the first overmolded array of electrical contacts and may also define a plurality apertures.

The second overmolded array of electrical contacts may define a plurality of apertures and each electrical contact of the second overmolded array of electrical contacts may define an electrical mating connector extending past an edge of an overmold of the second overmolded array of electrical contacts at the mating end of the wafer assembly. The second ground shield is configured to be assembled with the second overmolded array of electrical contacts and may also define a plurality of apertures.

The conductive ground bracket may define a first array of ridges on a first side of the conductive bracket. Each ridge of the first array of ridges is positioned in an aperture of the plurality of apertures defined by the first overmolded array of electrical contacts and is positioned in an aperture of the plurality of apertures defined by the first ground shield.

The conductive ground bracket may define a second array of ridges on a second side of the conductive ground bracket that is opposite to the first side of the conductive ground bracket. Each ridge of the second array of ridges is positioned in an aperture of the plurality of apertures defined by the second overmolded array of electrical contacts and is positioned in an aperture of the plurality of apertures defined by the second ground shield.

The conductive ground bracket, first ground shield, and second ground shield may provide the wafer assembly with a common ground.

DETAILED DESCRIPTION

Figure 1:
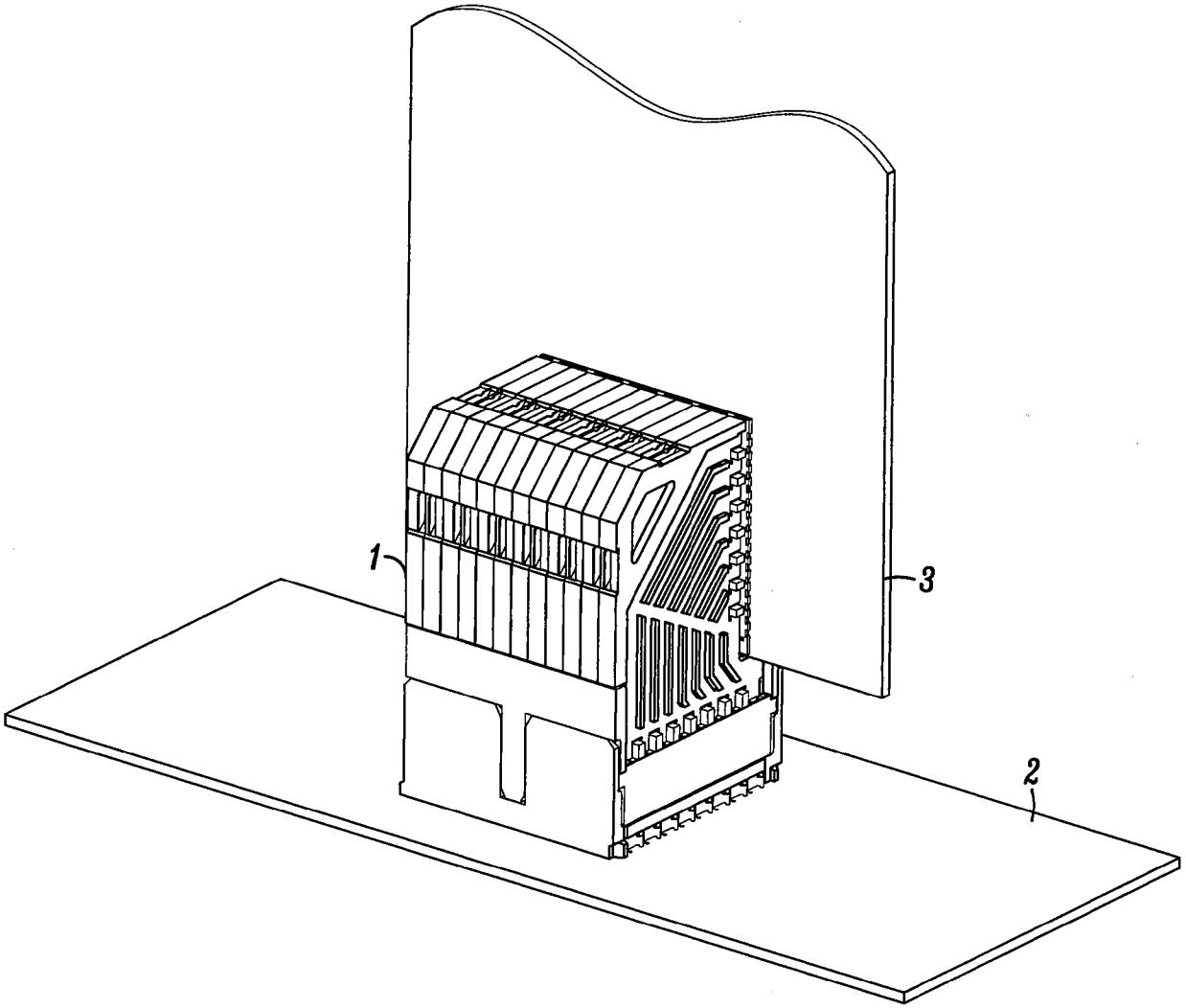
FIG. 1 is a diagram of a backplane connector system connecting a first substrate to a second substrate.

The present disclosure is directed to high-speed backplane connector systems that are capable of operating at speeds of up to at least 20 Gbps, while in some implementations also providing pin densities of at least 50 pairs of electrical connectors per inch. As will be explained in more detail below, implementations of the disclosed high-speed connector systems may provide ground shields and/or ground structures that substantially encapsulate electrical connector pairs, which may be differential electrical connector pairs, in a three-dimensional manner throughout a backplane footprint, a backplane connector, and a daughtercard footprint. These encapsulating ground shields and/or ground structures prevent undesirable propagation of non-traverse, longitudinal, and higher-order modes, and minimize cross-talk, when the high-speed backplane connector systems operates at frequencies up to at least 20 Gbps. Further, as explained in more detail below, implementations of the disclosed high-speed connector systems may provide substantially identical geometry between each connector of an electrical connector pair to prevent longitudinal moding.

A high-speed backplane connector system 100 is described with respect to FIGS. 2-13. The high-speed backplane connector 100 includes a plurality of wafer assemblies 102 that, as explained in more detail below, are positioned adjacent to one another within the connector system 100 by a wafer housing 104. The plurality of wafer assemblies 102 serves to provide an array of electrical paths between multiple substrates. The electrical paths may be, for example, signal paths or ground potential paths.

Each wafer assembly 106 of the plurality of wafer assemblies 102 may include a first overmolded array of electrical contacts 108 (also known as a first lead frame assembly), a second overmolded array of electrical contacts 110 (also known as a second lead frame assembly), a first ground shield 112, a second ground shield 114, and a ground bracket 115. The first overmolded array of electrical contacts 108 includes a plurality of electrical contacts 116 surrounded by an insulating overmold 118, such as an overmolded plastic dielectric. The electrical contacts 116 may comprise, for example, any copper (Cu) alloy material.

Figure 10:
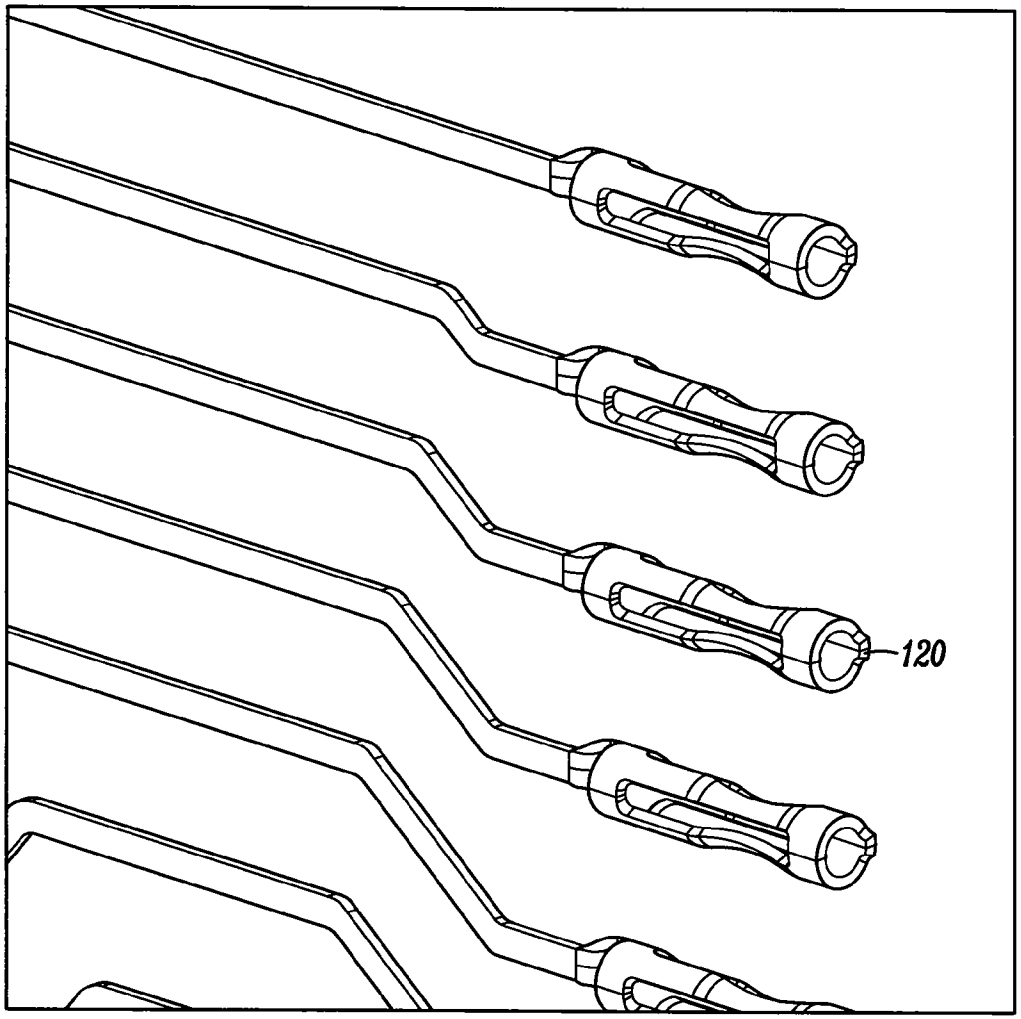
FIG. 10 illustrates a closed-band electrical mating connector.
Figure 11:
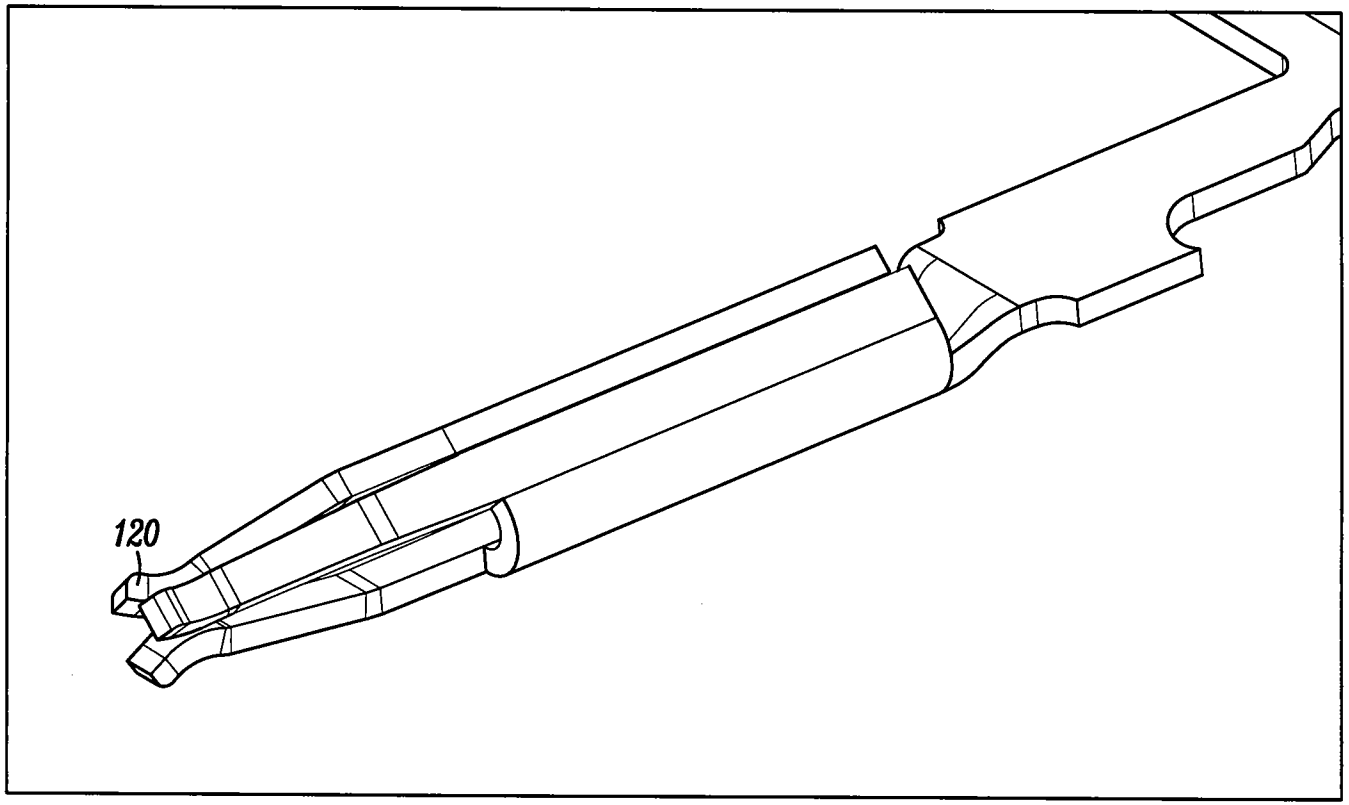
FIG. 11 illustrates a tri-beam electrical mating connector.
Figure 12:
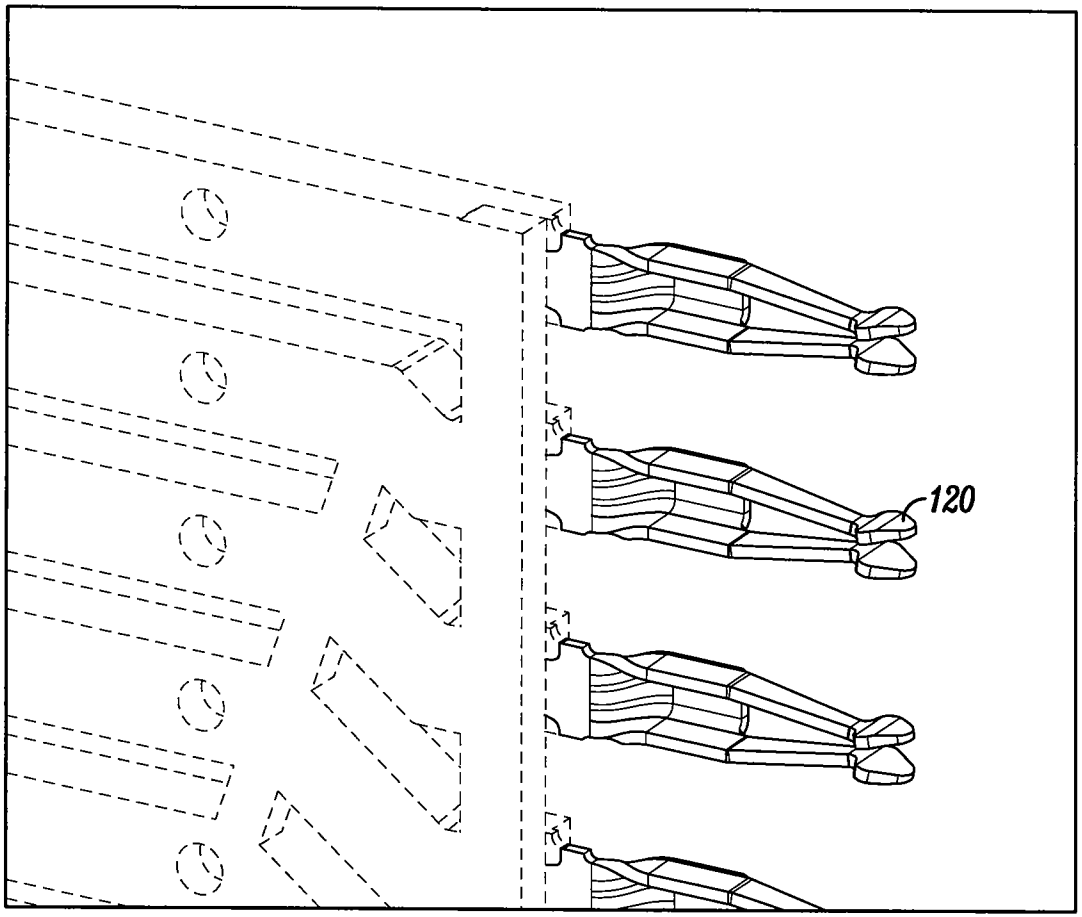
FIG. 12 illustrates a dual-beam electrical mating connector.
Figure 13:
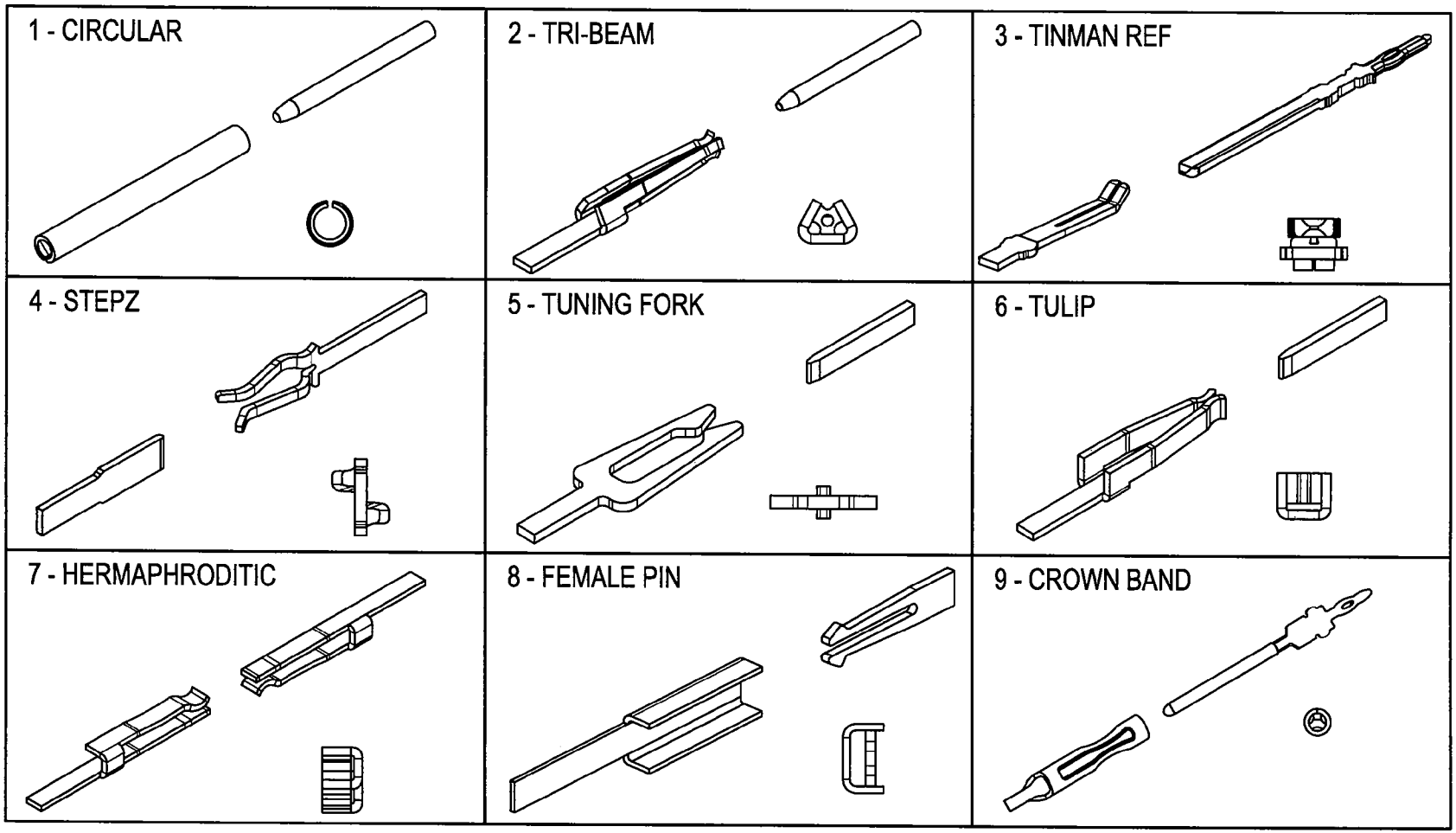
FIG. 13 illustrates additional implementations of electrical mating connectors.

The electrical contacts 116 define electrical mating connectors 120 that extend away from the insulating overmold 118 at a mating end 122 of the wafer assembly 106 and the electrical contacts define substrate engagement elements 124, such as electrical contact mounting pins, that extend away from the insulating overmold 118 at a mounting end 126 of the wafer assembly 106. In some implementations, the electrical mating connectors 120 are closed-band shaped as shown in FIG. 10, where in other implementations, the electrical mating connectors 120 are tri-beam shaped as shown in FIG. 11 or dual-beam shaped as shown in FIG. 12. Other mating connector styles could have a multiplicity of beams. Examples of yet other implementations of electrical mating connectors 120 are shown in FIG. 13.

It will be appreciated that the tri-beam shaped, dual-beam shaped, or closed-band shaped electrical mating connectors 120 provide improved reliability in a dusty environment and provide improved performance in a non-stable environment, such as an environment with vibration or physical shock.

Referring to FIGS. 2-9, like the first overmolded array of electrical contacts 108, the second overmolded array of electrical contacts 110 includes a plurality of electrical contacts 128 surrounded by an insulating overmold 130. The electrical contacts 128 define electrical mating connectors 132 that extend away from the insulating overmold 130 at the mating end 122 of the wafer assembly 106 and the electrical contacts 128 define substrate engagement elements 133, such as electrical contact mounting pins, that extend away from the insulating overmold 130 at the mounting end 126 of the wafer assembly 106.

Figure 7:
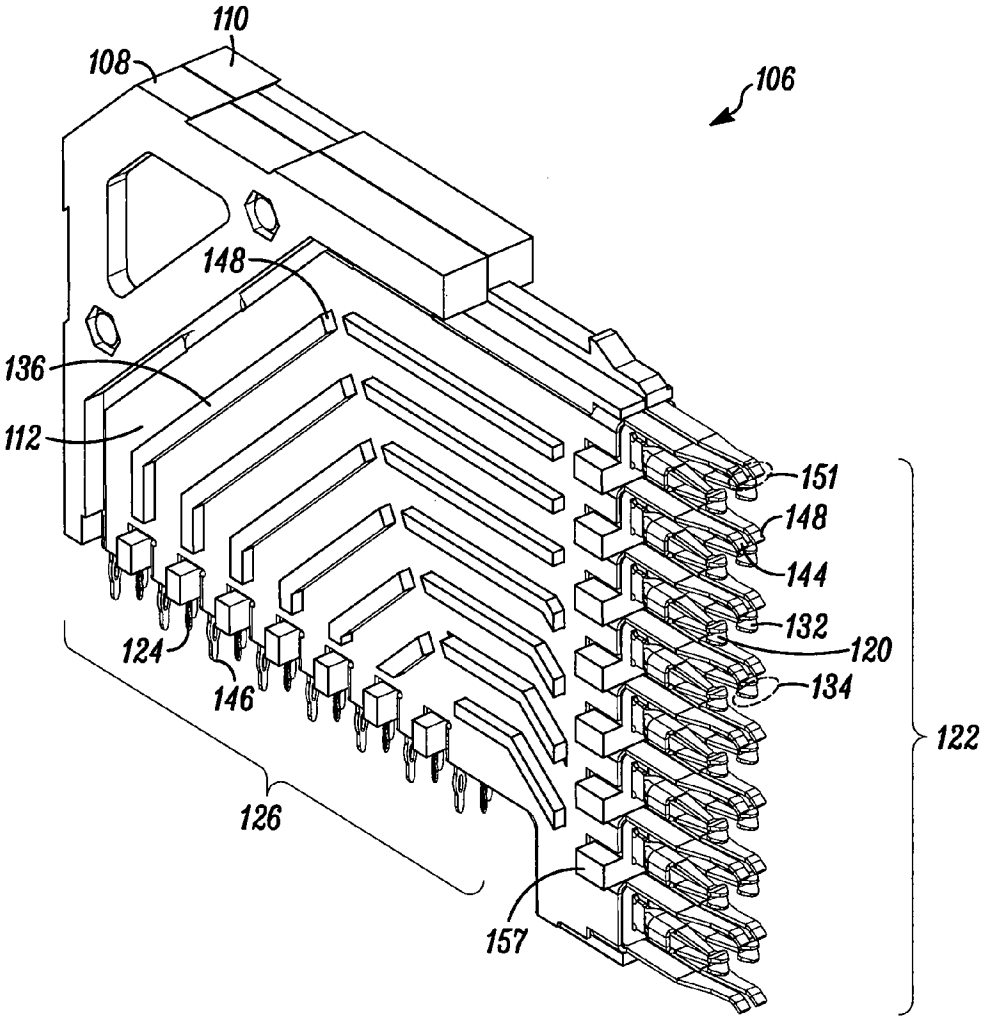
FIG. 7 is a perspective view of a wafer assembly.
Figure 8:
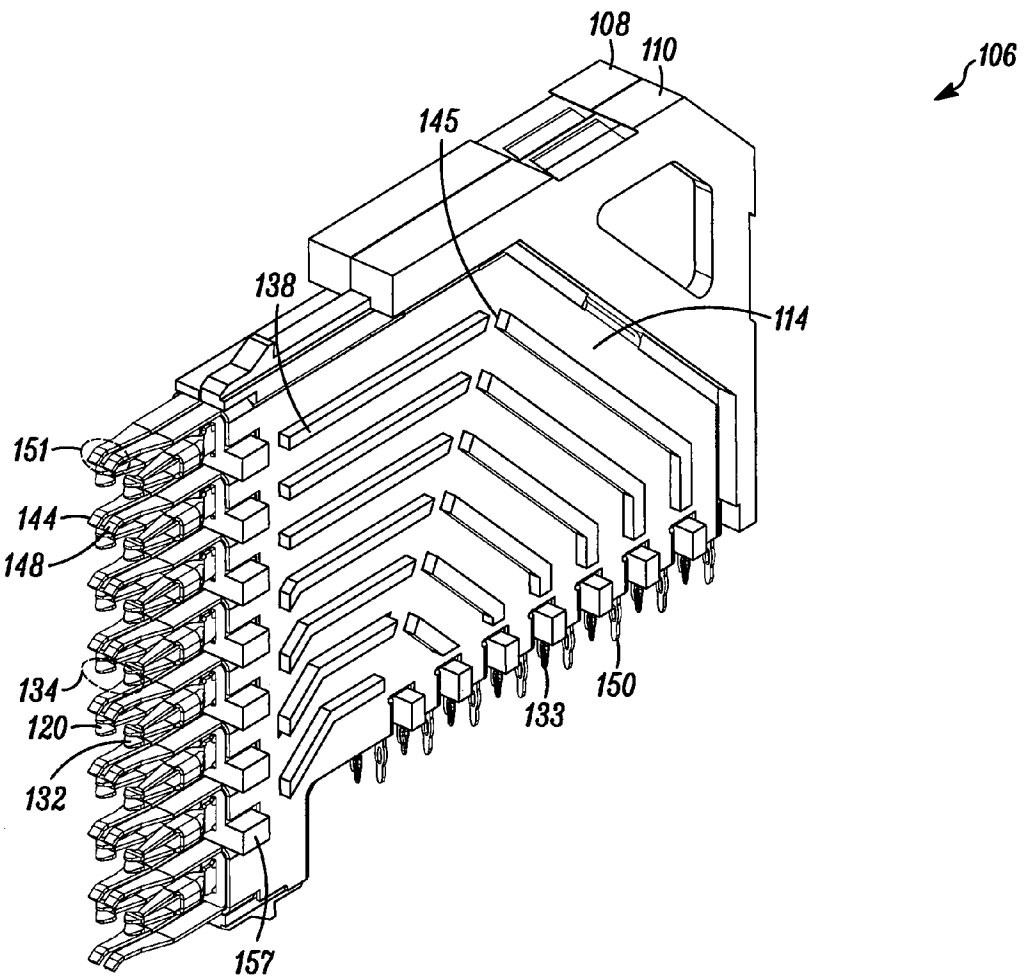
FIG. 8 is an additional perspective view of a wafer assembly.

The first overmolded array of electrical contacts 108 and the second overmolded array of electrical contacts 110 are configured to be assembled together as shown in FIGS. 7 and 8. In some implementations, when assembled together, each electrical contact 116 of the first overmolded array of electrical contacts 108 is positioned adjacent to an electrical contact 128 of the second overmolded array of electrical contacts 110 to form a plurality of electrical contact pairs 134, which may be differential pairs. In implementations where each electrical contact 116 of the first overmolded array of electrical contacts 108 is positioned adjacent to an electrical contact 128 of the second overmolded array of electrical contacts 110, a distance between an electrical contact of the first overmolded array of electrical contacts 108 and an adjacent electrical contact of the second overmolded array of electrical contacts 110 may remain substantially the same throughout the wafer assembly 106.

In some implementations, each electrical mating connector 120 of the first overmolded array of electrical contacts 108 mirrors an adjacent electrical mating connector 132 of the second overmolded array of electrical contacts 110. It will be appreciated that mirroring the electrical contacts of the electrical contact pair provides advantages in manufacturing as well as column-to-column consistency for high-speed electrical performance, while still providing a unique structure in pairs of two columns.

Figure 9:
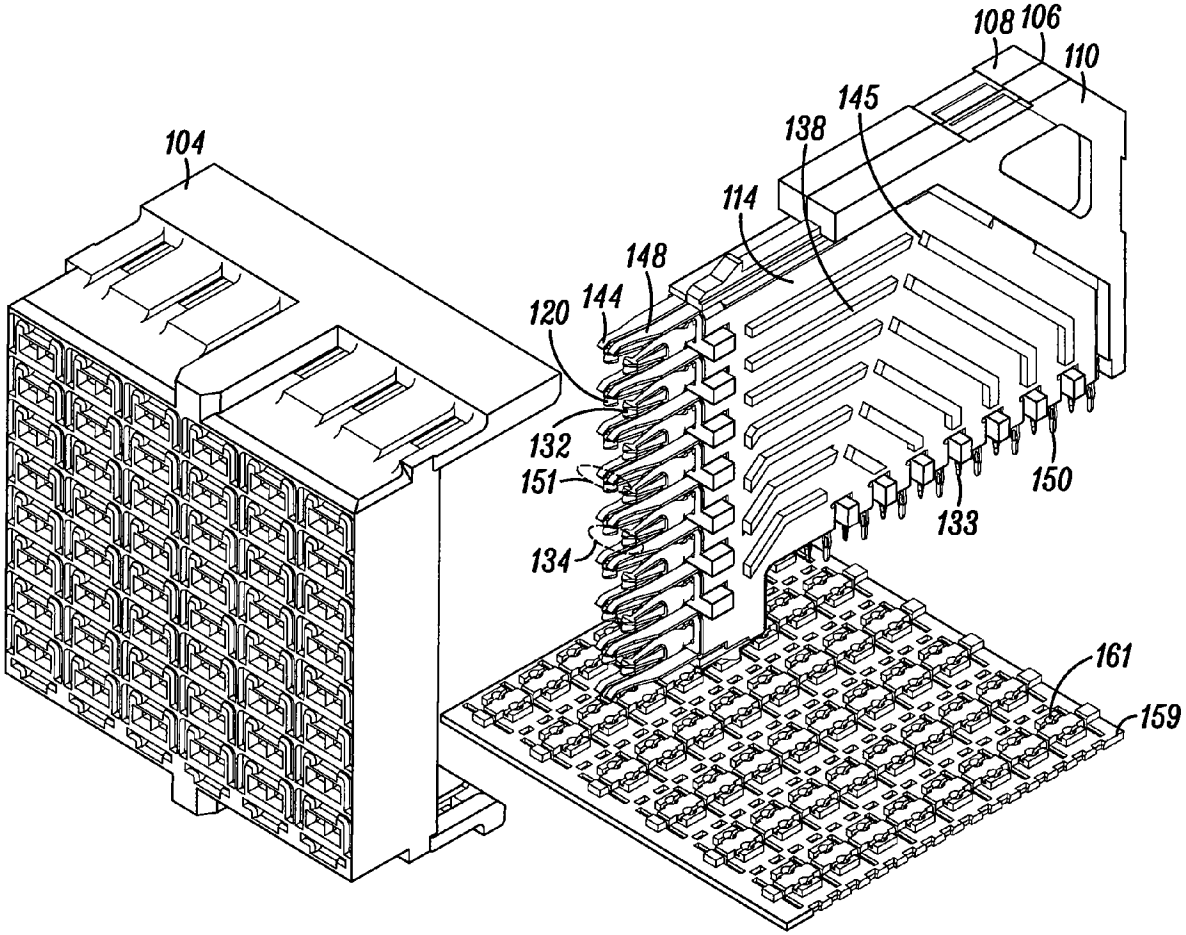
FIG. 9 is a partially exploded view of a portion of a high-speed backplane connector system.

As shown in FIGS. 7-9, when the wafer assembly 106 is assembled, the ground bracket 115 is positioned between a portion of the first overmolded array of electrical contacts 108 and a portion of the second overmolded array of electrical contacts 110. The ground bracket 115 may comprise die casting metal, with tin (Sn) over nickel (Ni) plating, or other electrically conductive platings, base metals, conductive plastic, or plated plastic.

Figure 6:
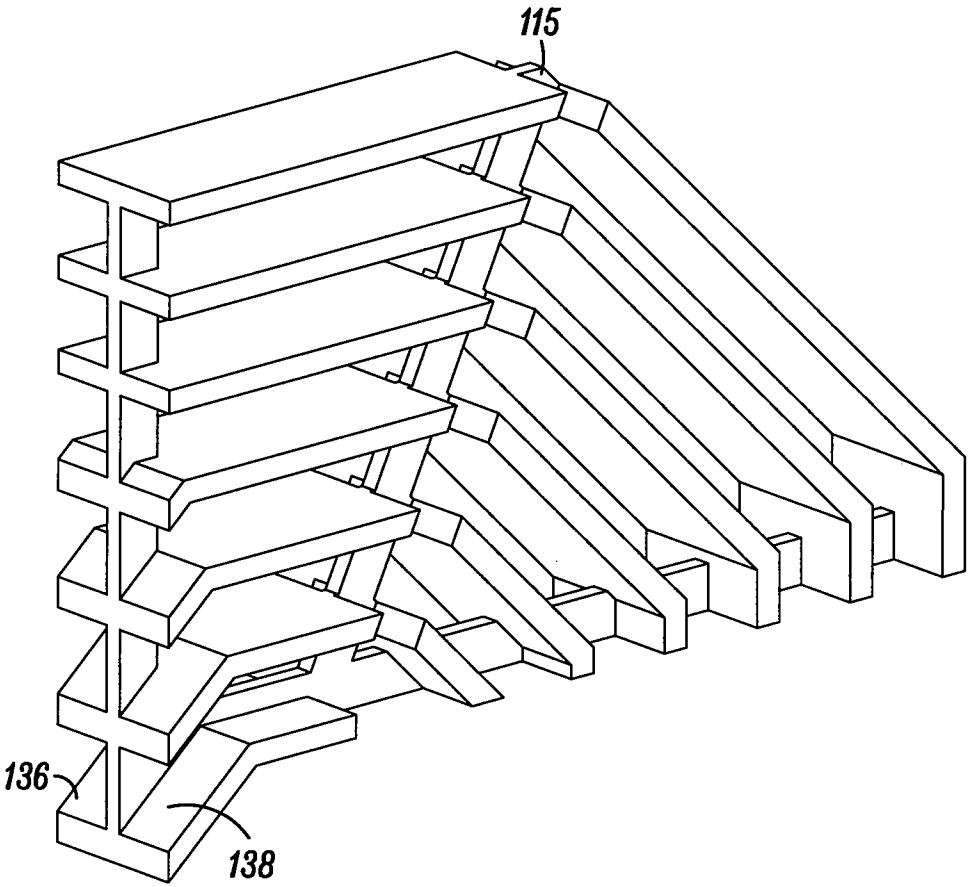
FIG. 6 is a perspective view of a ground bracket.

Referring to FIG. 6, in one implementation, the ground bracket 115 defines a first plurality of ridges 136 (also known as an array of ridges) on a first side of the ground bracket 115 and defines a second plurality of ridges 138 on a second side of the ground bracket 115 that is opposite to the first side of the ground bracket 115. The first overmolded array of electrical contacts 108 defines a plurality of apertures 140 configured to receive the first plurality of ridges 136 defined by the first side of the ground bracket 115. In one implementation, for each neighboring pair of electrical contacts 116 of the first overmolded array of electrical contacts 108, a ridge of the first plurality of ridges 136 of the ground bracket 115 passes through the first overmolded array of electrical contacts 108 and is positioned between the neighboring pair of electrical contacts.

Similarly, the second overmolded array of electrical contacts 110 defines a plurality of apertures 142 configured to receive the second plurality of ridges 138 defined by the second side of the ground bracket 115. In one implementation, for each neighboring pair of electrical contacts 128 of the second overmolded array of electrical contacts 110, a ridge of the second plurality of ridges 138 of the ground bracket 115 passes through the second overmolded array of electrical contacts 110 and is positioned between the neighboring pair of electrical contacts.

The first ground shield 112 is configured to be assembled with the first overmolded array of electrical contacts 108 such that the first ground shield 112 is positioned at a side of the first overmolded array of electrical contacts 108 as shown in FIG. 7. Similarly, the second ground shield 114 is configured to be assembled with the second overmolded array of electrical contacts 110 such that the second ground shield 114 is positioned at a side of the second overmolded array of electrical contacts 110 as shown in FIG. 8. In some implementations, the first ground shield 112 and the second ground shield 114 may comprise a base material such as phosphor bronze with tin (Sn) over nickel (Ni) at the mounting end 126 of the ground shield and gold (Au) over nickel (Ni) at the mating end 122 of the ground shield.

When the first overmolded array of electrical contacts 108, second overmolded array of electrical contacts 110, first ground shield 112, second ground shield 114, and ground bracket 115 are assembled, the ends of the first plurality of ridges 136 are positioned in the wafer assembly 106 adjacent to the first ground shield 112 and the ends of the second plurality of ridges 138 are positioned in the wafer assembly 106 adjacent to the second ground shield 114. The positioning of the first ground shield 112, the second ground shield 114, and the ground bracket 115 assist in providing a common ground to the wafer assembly 106.

Figure 14:
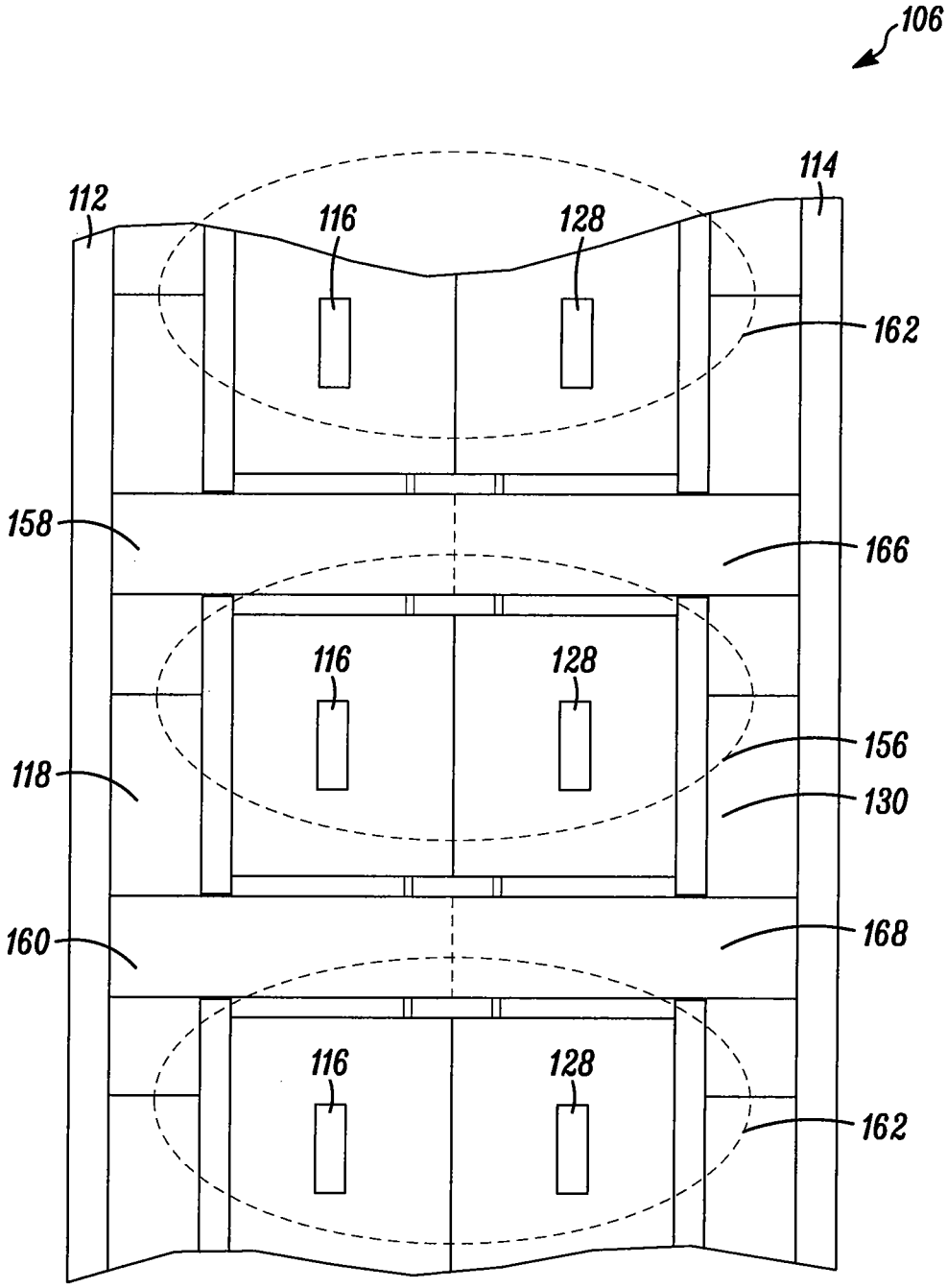
FIG. 14 is a cross-sectional view of a wafer assembly.

Additionally, it will be appreciated that the positioning of the first ground shield 112, the second ground shield 114, and the ground bracket 115 serve to electrically isolate each electrical contact pair 134 from neighboring electrical contacts pairs. For example, referring to FIG. 14, an electrical contact pair 156 is substantially surrounded in the wafer assembly 106, and electrically isolated from neighboring electrical contact pairs 162, by the first ground shield 112, a first ridge 158 of the first plurality of ridges 136 of the ground bracket 115, a second ridge 160 of the first plurality of ridges 136 of the ground bracket 115, a first ridge 166 of the second plurality of ridges 138 of the ground bracket 115, a second ridge 168 of the second plurality of ridges 138 of the ground bracket 115, and the second ground shield 114.

Figure 4:
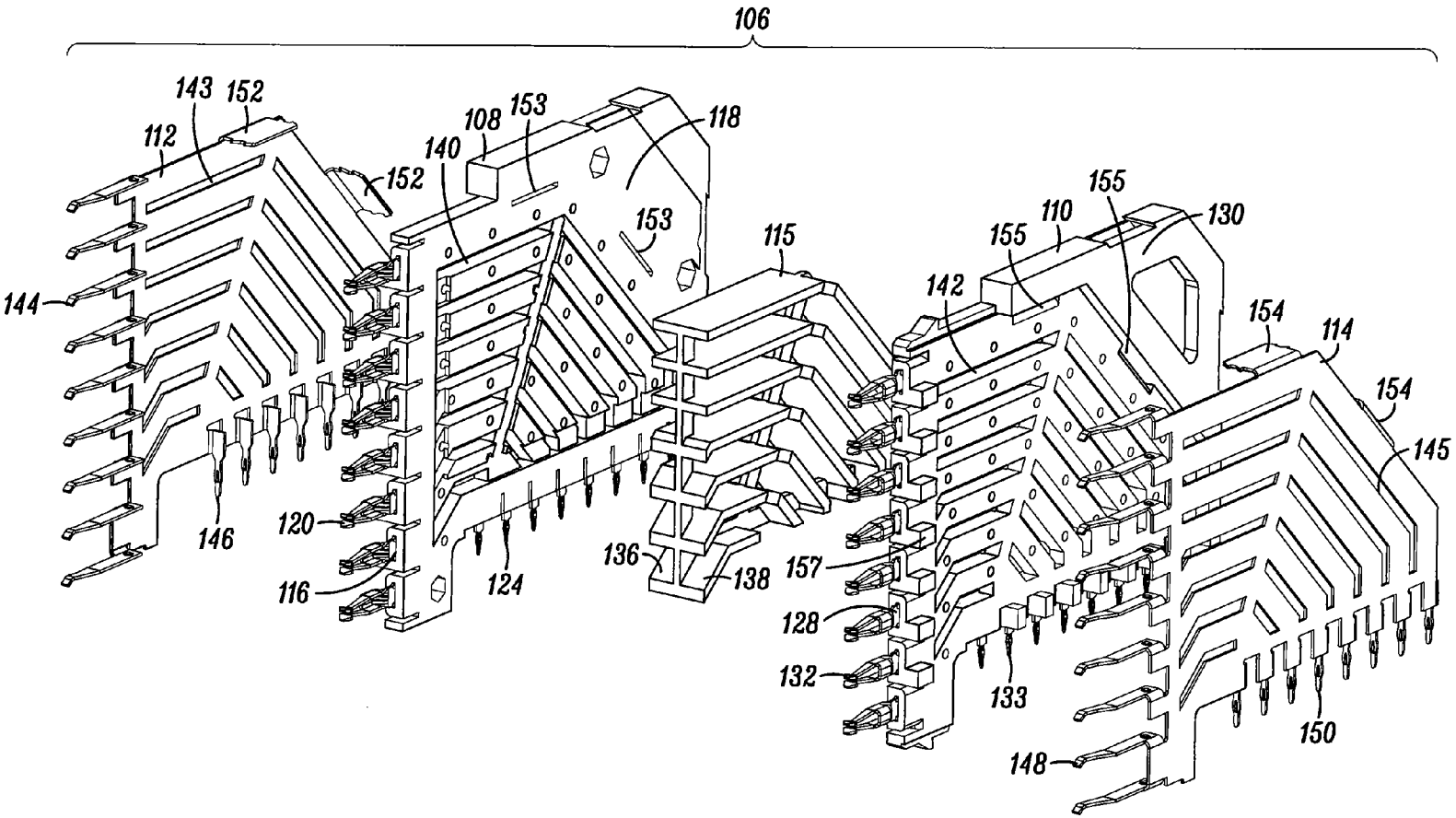
FIG. 4 is an exploded view of a wafer assembly.
Figure 5:
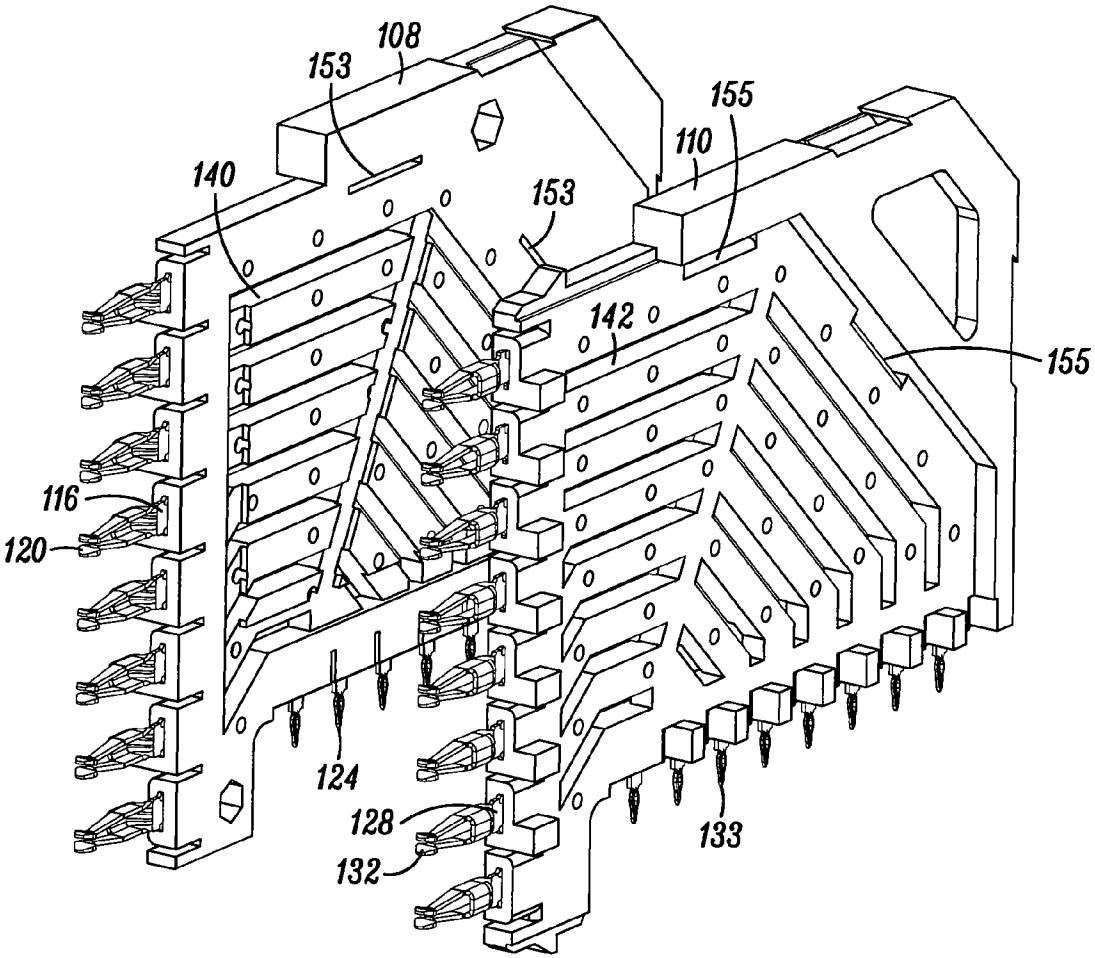
FIG. 5 is a perspective view of a first overmolded array of electrical connectors and a second overmolded array of electrical connectors.

In some implementations, the ends of the first plurality of ridges 136 may abut and/or connect to the first ground shield 112 and the ends of the second plurality of ridges 138 may abut and/or connect to the second ground shield 114. Referring to FIGS. 4, 7, 8, in other implementations, the first ground shield 112 may define a plurality of apertures 143 configured to receive ends of the first plurality of ridges 136 of the ground bracket 115 that extend through the first overmolded array of electrical contacts 108. Similarly, the second ground shield 114 may define a plurality of apertures 145 configured to receive ends of the second plurality of ridges 138 of the ground bracket 115 that extend through the second overmolded array of electrical contacts 110. In some implementations, the first and second ground shields 112, 114 may retain the ground bracket 115 using cold staking or an interference fit.

Referring to FIGS. 4, 7, and 8, the first ground shield 112 may define a plurality of ground tab portions 144 at the mating end 122 of the wafer assembly and the first ground shield 112 may define a plurality of substrate engagement elements 146, such as ground mounting pins, at the mounting end 126 of the wafer assembly 106. In some implementations, when the first ground shield 112 is assembled with the first overmolded array of electrical contacts 108, each ground tab portion of the plurality of ground tab portions 144 of the first ground shield 112 is positioned above and/or below an electrical mating connector 120 of the first overmolded array of electrical contacts 108.

Similar to the first ground shield 112, the second ground shield 114 may define a plurality of ground tab portions 148 at the mating end 122 of the wafer assembly and the second ground shield 114 may define a plurality of substrate engagement elements 150, such as ground mounting pins, at the mounting end 126 of the wafer assembly 106. In some implementations, when the second ground shield 114 is assembled to the second overmolded array of electrical contacts 110, a ground tab portion of the plurality of ground tab portions 148 of the second ground shield 114 is positioned above and/or below an electrical mating connectors 132 of the second overmolded array of electrical contacts 110.

When the wafer assembly 106 is assembled, each ground tab portion of the plurality of ground tab portions 144 of the first ground shield 112 may be positioned adjacent to a ground tab portion of the plurality of ground tab portions 148 of the second ground shield 114 to form a plurality of ground tabs 151. The positioning of the plurality of ground tab portions 144 of the first ground shield 112 adjacent to the plurality of ground tab portions 148 of the second ground shield 114 may assist in providing a common ground to the wafer assembly 106.

In some implementations, a ground tab portion 144 of the first ground shield 112 engages and/or abuts an adjacent ground tab portion 148 of the second ground shield 114. However, in other implementations, a ground tab portion 144 of the first ground shield 112 does not engage or abut an adjacent ground tab portion 148 of the second ground shield 114.

Referring to FIG. 4, the first ground shield 112 may define one or more engagement elements 152 that engage the first overmolded array of electrical contacts 108 when the first ground shield 112 is assembled to the first overmolded array of electrical contacts 108. In some implementations, one or more of the engagement elements 152 may be a barbed tab that is positioned within an aperture 153 of the first overmolded array of electrical contacts 108 that is dimensioned to receive the barbed tab. The second ground shield 114 may also define one or more engagement elements 154 that engage the second overmolded array of electrical contacts 110 when the second ground shield 114 is assembled to the second overmolded array of electrical contacts 110. In some implementations, one or more of the engagement elements 154 may be a barbed tab that is positioned within an aperture 155 of the second overmolded array of electrical contacts 110 that is dimensioned to receive the barbed tab.

When the wafer assembly 106 is assembled, an engagement element 152 of the first ground shield 112 may be positioned adjacent to an engagement element 154 of the second ground shield 114. The positioning of the engagement element 152 of the first ground shield 112 adjacent to the engagement element 154 of the second ground shield 114 may assist in providing the wafer assembly 106 with a common ground.

In some implementations, an engagement element 152 of the first ground shield 112 may abut and/or engage an adjacent engagement element 154 of the second ground shield. However, in other implementations, an engagement element 152 of the first ground shield 112 does not abut or engage an adjacent engagement element 154 of the second ground shield 114.

Figure 2:
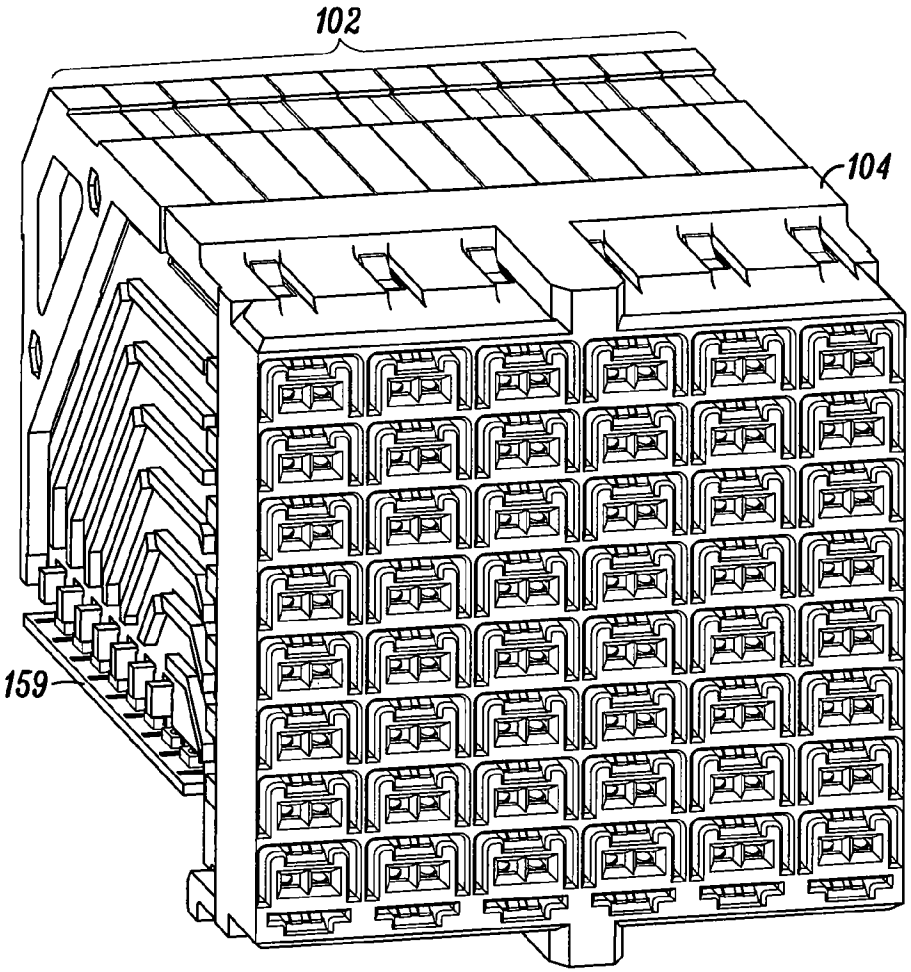
FIG. 2 is a perspective view of a portion of a high-speed backplane connector system.
Figure 3:
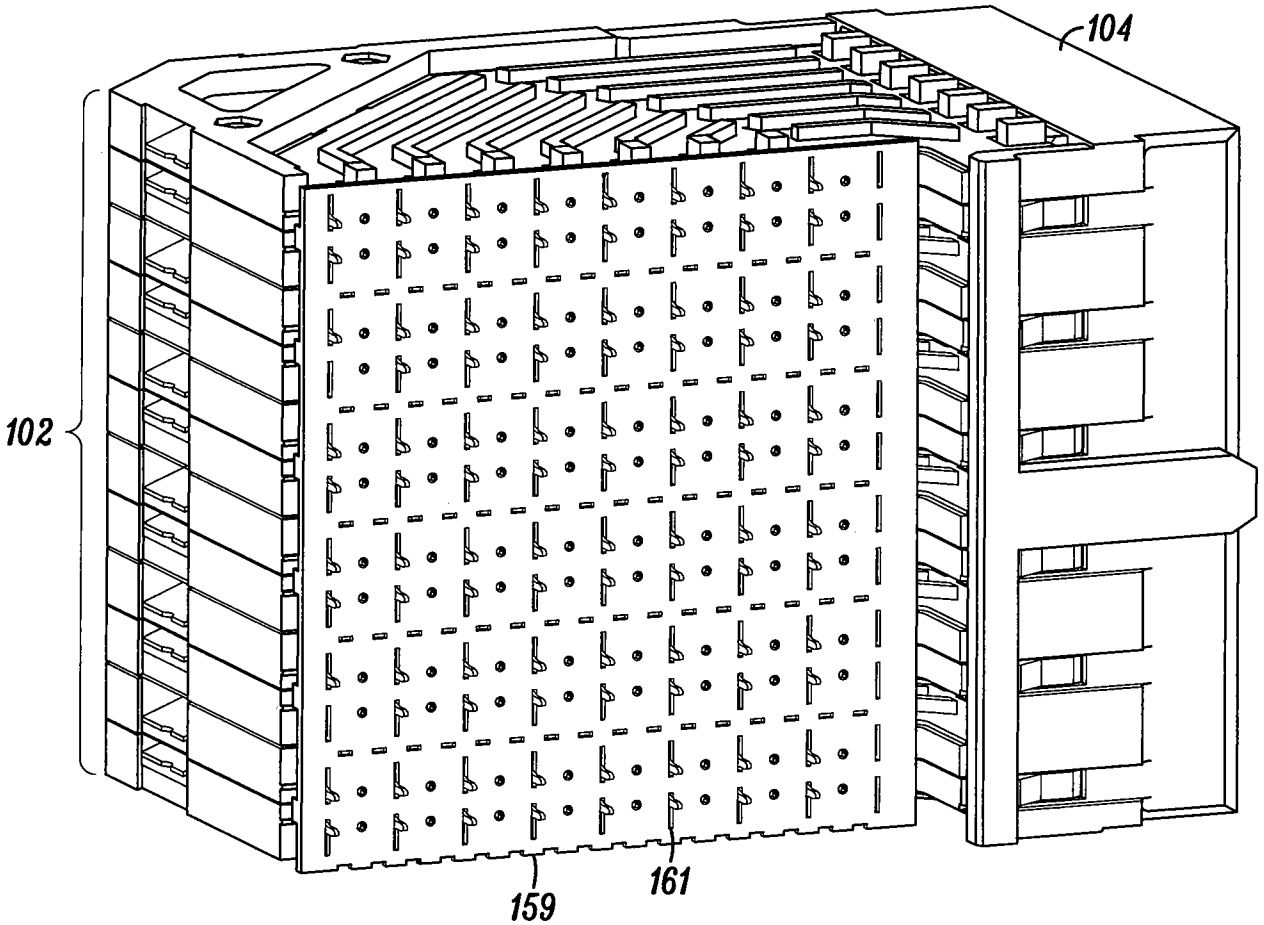
FIG. 3 is a bottom view of a portion of a high-speed backplane connector system.

As shown in FIGS. 2 and 3, the wafer housing 104 positions the wafer assemblies 106 of the plurality of wafer assemblies 102 adjacent to one another when the high-speed backplane connector system 100 is assembled. The wafer housing 104 engages the plurality of wafer assemblies 102 at the mating end 122 of each wafer assembly 106. The wafer housing 104 accepts the electrical mating connectors 120, 132 and ground tabs 151 extending from each wafer assembly 106. In some implementations, the first overmolded array of electrical contacts 108 and/or the second overmolded array of electrical contacts 110 of the wafer assembly 106 may define one or more stops 157 that abut the wafer housing 104 when the wafer assembly 106 is positioned in the wafer housing 104. It will be appreciated that the stops 157 may prevent the electrical mating connectors 120, 132 and ground tabs 151 extending from each wafer assembly 106 from being damaged when the wafer assembly 106 is placed in the wafer housing 104.

The wafer housing 104 may be configured to mate with a header module, such as the header module described in U.S. patent application Ser. No. 12/474,568, filed May 29, 2009, the entirety of which is hereby incorporated by reference.

As shown in FIGS. 3 and 9, an organizer 159, such as one of the organizers described in U.S. patent application Ser. No. 12/474,568, filed May 29, 2009, may be positioned at the mounting end 126 of the plurality of wafer assemblies 102 that serves to securely lock the plurality of wafer assemblies 102 together. The organizer 159 comprises a plurality of apertures 161 that allow the substrate engagement elements 124, 133 146, 150 extending from each wafer assembly 106 to pass through the organizer 159 and engage with a substrate such as a backplane circuit board or a daughtercard circuit board, as known in the art. In some implementations, the substrate engagement elements 124, 133, 146, 150 passing through the organizer 159 may form a noise-cancelling footprint, such as one of the noise cancelling footprints described in U.S. patent application Ser. No. 12/474,568, filed May 29, 2009.

While various high-speed backplane connector systems have been described with reference to particular embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. An electrical connector system comprising:

a plurality of wafer assemblies defining a mating end and a mounting end, each of the wafer assemblies comprising:

a first overmolded array of electrical contacts, each electrical contact of the first overmolded array of electrical contacts defining an electrical mating connector extending past an edge of an overmold of the first overmolded array of electrical contacts at the mating end of the wafer assembly, the first overmolded array of electrical contacts defining a plurality of apertures;

a second overmolded array of electrical contacts configured to be assembled with the first overmolded array of electrical contacts, each electrical contact of the second overmolded array of electrical contacts defining an electrical mating connector extending past an edge of an overmold of the second overmolded array of electrical contacts at the mating end of the wafer assembly, the second overmolded array of electrical contacts defining a plurality of apertures; and a conductive ground bracket positioned in the wafer assembly between a portion of the first overmolded array of electrical contacts and a portion of the second overmolded array of electrical contacts;

wherein the conductive ground bracket defines a first array of ridges on a first side of the conductive ground bracket, each ridge of the first array of ridges positioned in an aperture of the plurality of apertures defined by the first overmolded array of electrical contacts;

wherein the conductive ground bracket defines a second array of ridges on a second side of the conductive ground bracket that is opposite to the first side of the conductive ground bracket, each ridge of the second array of ridges positioned in an aperture of the plurality of apertures defined by the second overmolded array of electrical contacts; and wherein for each wafer assembly of the plurality of wafer assemblies, each electrical contact of the first overmolded array of electrical contacts is positioned in the wafer assembly adjacent to an electrical contact of the second overmolded array of electrical contacts to form a plurality of electrical contact pairs, and wherein for each electrical contact pair, the electrical mating connector of the electrical contact of the first overmolded array of electrical contacts is horizontally aligned with the electrical mating connector of the electrical contact of the second overmolded array of electrical contacts.

2. The electrical connector system of claim 1, wherein the conductive ground bracket comprises die casting metal.

3. The electrical connector system of claim 1, wherein the conductive ground bracket comprises conductive plastic.

4. The electrical connector system of claim 1, wherein each of the wafer assemblies further comprises:

a first ground shield configured to be assembled with the first overmolded array of electrical contacts, wherein an end of each ridge of the first array of ridges defined by the conductive ground bracket is positioned in the wafer assembly adjacent to the first ground shield; and a second ground shield configured to be assembled with the second overmolded array of electrical contacts, wherein an end of each ridge of the second array of ridges defined by the conductive ground bracket is positioned in the wafer assembly adjacent to the second ground shield; and where the conductive ground bracket, the first ground shield, and the second ground shield are electrically commoned to provide the wafer assembly with a common ground.

5. The electrical connector system of claim 1, wherein each of the wafer assemblies further comprises:

a first ground shield configured to be assembled with the first overmolded array of electrical contacts, the first ground shield defining a plurality of apertures; and a second ground shield configured to be assembled with the second overmolded array of electrical contacts, the second ground shield defining a plurality of apertures;

wherein at least a portion of a ridge of the first array of ridges defined by the conductive ground bracket passes through an aperture of the plurality of apertures defined by the first overmolded array of electrical contacts and is positioned in an aperture of the plurality of apertures defined by the first ground shield; and wherein at least a portion of a ridge of the second array of ridges defined by the conductive ground bracket passes through an aperture of the plurality of apertures defined by the second overmolded array of electrical contacts and is positioned in an aperture of the plurality of apertures defined by the second ground shield; and wherein for each of the wafer assemblies, the conductive ground bracket, the first ground shield, and the second ground shield provide the wafer assembly with a common ground.

6. The electrical connector system of claim 5, wherein for each of the wafer assemblies:

the first ground shield defines a plurality of ground tab portions extending past the edge of the overmold of the first overmolded array of electrical contacts when the first ground shield is assembled with the first overmolded array of electrical contacts;

the second ground shield defines a plurality of ground tab portions extending past the edge of the overmold of the second overmolded array of electrical contacts when the second ground shield is assembled with the second overmolded array of electrical contacts; and each ground tab portion of the plurality of ground tab portions of the first ground shield is positioned in the wafer assembly adjacent to a ground tab portion of the plurality of ground tab portions of the second ground shield to form a plurality of ground tabs.

7. The electrical connector system of claim 6, wherein for each wafer assembly, a ground tab of the plurality of ground tabs is positioned between two pairs of electrical mating connectors of the plurality of electrical contact pairs at the mating end of the wafer assembly.

8. The electrical connector system of claim 1, where each electrical contact of the second overmolded array of electrical contacts mirrors an adjacent electrical contact of the first overmolded array of electrical contacts.

9. The electrical connector system of claim 1, wherein a distance between an electrical contact of the first overmolded array of electrical contacts and an adjacent electrical contact of the second overmolded array of electrical contacts is substantially the same throughout a wafer assembly of the plurality of wafer assemblies.

10. The electrical connector system of claim 1, wherein the overmold of the first overmolded array of electrical contacts and the overmold of the second overmolded array of electrical contacts comprises plastic.

11. The electrical connector system of claim 1, wherein for each wafer assembly, the first overmolded array of electrical contacts defines a plurality of stops configured to abut a wafer housing when the wafer assembly is positioned in the wafer housing

12. A wafer assembly comprising:

a first overmolded array of electrical contacts, each electrical contact of the first overmolded array of electrical contacts defining an electrical mating connector extending past an edge of an overmold of the first overmolded array of electrical contacts at a mating end of the wafer assembly, the first overmolded array of electrical contacts defining a plurality of apertures;

a second overmolded array of electrical contacts configured to be assembled with the first overmolded array of electrical contacts, each electrical contact of the second overmolded array of electrical contacts defining an electrical mating connector extending past an edge of an overmold of the second overmolded array of electrical contacts at the mating end of the wafer assembly, the second overmolded array of electrical contacts defining a plurality of apertures; and a conductive ground bracket positioned in the wafer assembly between a portion of the first overmolded array of electrical contacts and a portion of the second array of electrical contacts;

wherein the conductive ground bracket defines a first array of ridges on a first side of the conductive ground bracket, each ridge of the first array of ridges positioned in an aperture of the plurality of apertures defined by the first overmolded array of electrical contacts;

wherein the conductive ground bracket defines a second array of ridges on a second side of the conductive ground bracket that is opposite to the first side of the conductive ground bracket, each ridge of the second array of ridges positioned in an aperture of the plurality of apertures defined by the second overmolded array of electrical contacts; and wherein each electrical contact of the first overmolded array of electrical contacts is positioned in the wafer assembly adjacent to an electrical contact of the second overmolded array of electrical contacts to form a plurality of electrical contact pairs, and wherein for each electrical contact pair, the electrical mating connector of the electrical contact of the first overmolded array of electrical contacts is horizontally aligned with the electrical mating connector of the electrical contact of the second overmolded array of electrical contacts.

13. The wafer assembly of claim 12, further comprising:

a first ground shield configured to be assembled with the first overmolded array of electrical contacts, wherein an end of each ridge of the first array of ridges defined by the conductive ground bracket is positioned in the wafer assembly adjacent to the first ground shield; and a second ground shield configured to be assembled with the second overmolded array of electrical contacts, wherein an end of each ridge of the second array of ridges defined by the conductive ground bracket is positioned in the wafer assembly adjacent to the second ground shield.

14. The wafer assembly of claim 13, where the conductive ground bracket, the first ground shield, and the second ground shield are electrically commoned to provide the wafer assembly with a common ground.

15. The wafer assembly of claim 12, further comprising:

a first ground shield configured to be assembled with the first overmolded array of electrical contacts, the first ground shield defining a plurality of apertures; and a second ground shield configured to be assembled with the second overmolded array of electrical contacts, the second ground shield defining a plurality of apertures;

wherein at least a portion of a ridge of the first array of ridges defined by the conductive ground bracket passes through an aperture of the plurality of apertures defined by the first overmolded array of electrical contacts and is positioned in an aperture of the plurality of apertures defined by the first ground shield; and wherein at least a portion of a ridge of the second array of ridges defined by the conductive ground bracket passes through an aperture of the plurality of apertures defined by the second overmolded array of electrical contacts and is positioned in an aperture of the plurality of apertures defined by the second ground shield.

16. The wafer assembly of claim 15, wherein the conductive ground bracket, the first ground shield, and the second ground shield provide the wafer assembly with a common ground.

17. The wafer assembly of claim 15, wherein the first ground shield defines a plurality of ground tab portions extending past the edge of the overmold of the first overmolded array of electrical contacts when the first ground shield is assembled with the first overmolded array of electrical contacts;

wherein the second ground shield defines a plurality of ground tab portions extending past the edge of the overmold of the second overmolded array of electrical contacts when the second ground shield is assembled with the second overmolded array of electrical contacts; and wherein each ground tab portion of the plurality of ground tab portions of the first ground shield is positioned in the wafer assembly adjacent to a ground tab portion of the plurality of ground tab portions of the second ground shield to form a plurality of ground tabs.

18. A wafer assembly comprising:

a first overmolded array of electrical contacts, each electrical contact of the first overmolded array of electrical contacts defining an electrical mating connector extending past an edge of an overmold of the first overmolded array of electrical contacts at a mating end of the wafer assembly, the first overmolded array of electrical contacts defining a plurality of apertures;

a first ground shield configured to be assembled with the first overmolded array of electrical contacts, the first ground shield defining a plurality of apertures;

a second overmolded array of electrical contacts configured to be assembled with the first overmolded array of electrical contacts, each electrical contact of the second overmolded array of electrical contacts defining an electrical mating connector extending past an edge of an overmold of the second overmolded array of electrical contacts at the mating end of the wafer assembly, the second overmolded array of electrical contacts defining a plurality of apertures;

a second ground shield configured to be assembled with the second overmolded array of electrical contacts, the second ground shield defining a plurality of apertures; and a conductive ground bracket positioned in the wafer assembly between a portion of the first overmolded array of electrical contacts and a portion of the second array of electrical contacts;

wherein the conductive ground bracket defines a first array of ridges on a first side of the conductive ground bracket, each ridge of the first array of ridges positioned in an aperture of the plurality of apertures defined by the first overmolded array of electrical contacts and positioned in an aperture of the plurality of apertures defined by the first ground shield;

wherein the conductive ground bracket defines a second array of ridges on a second side of the conductive ground bracket that is opposite to the first side of the conductive ground bracket, each ridge of the second array of ridges positioned in an aperture of the plurality of apertures defined by the second overmolded array of electrical contacts and an aperture of the plurality of apertures defined by the second ground shield; and wherein the conductive ground bracket, first ground shield, and second ground shield provide the wafer assembly with a common ground.

19. The wafer assembly of claim 18, wherein the first ground shield defines a plurality of ground tab portions extending past the edge of the of the overmold of the first overmolded array of electrical contacts when the first ground shield is assembled with the first overmolded array of electrical contacts;

wherein the second ground shield defines a plurality of ground tab portions extending past the edge of the overmold of the second overmolded array of electrical contacts when the second ground shield is assembled with the second overmolded array of electrical contacts; and wherein each ground tab portion of the plurality of ground tab portions of the first ground shield is positioned in the wafer assembly adjacent to a ground tab portion of the plurality of ground tab portions of the second ground shield to form a plurality of ground tabs.

* * * * *